United States Patent [19]

Buelow et al.

[11] Patent Number: 4,507,811

[45] Date of Patent: Apr. 2, 1985

[54] TOILET BOWL DISPENSER

[75] Inventors: Jack Buelow, Danville; Michael A. Darland, Hayward, both of Calif.

[73] Assignee: The Clorox Company, Oakland, Calif.

[21] Appl. No.: 281,152

[22] Filed: Jul. 7, 1981

[51] Int. Cl.[3] ..... E03D 9/02

[52] U.S. Cl. ..... 4/225; 4/228

[58] Field of Search ..... 4/225, 227, 228; 222/57, 444

[56] References Cited

U.S. PATENT DOCUMENTS

| | | | |
|---|---|---|---|
| 2,045,473 | 6/1936 | Keillor | 4/227 |
| 2,351,579 | 6/1944 | Beckman | 4/227 X |
| 2,839,763 | 6/1958 | Newsom | 4/227 |
| 3,061,892 | 8/1960 | Woodruff | 4/225 |
| 4,064,572 | 12/1977 | Wicks et al. | 4/227 |
| 4,168,550 | 9/1979 | Lindauer | 4/227 X |
| 4,171,546 | 10/1979 | Wages | 4/228 |
| 4,186,856 | 2/1980 | Dirsking | 222/424 |
| 4,216,027 | 8/1980 | Dirksing | 134/36 |
| 4,251,012 | 2/1981 | Owens et al. | 222/185 |

*Primary Examiner*—Charles E. Phillips
*Attorney, Agent, or Firm*—Stephen M. Westbrook

[57] ABSTRACT

A toilet bowl cleaner dispenser includes a reservoir for holding cleaner to be dispensed, an air cavity disposed below the reservoir, an air conduit including a portion communicating with an inlet to the reservoir, a portion communicating with an outlet from the reservoir, a fill tube connecting the air cavity and the portion communicating with reservoir inlet, a measuring tube in communication with the air conduit, and a discharge tube connected to the measuring tube. The dispenser has no moving parts and is operable in response to rising toilet tank water to communicate pressurized air to the measuring tube to dispense a measured amount of cleaner from the discharge tube, which is configured to hook on and discharge into a toilet overflow tube.

A holding pocket is formed in the lower end of the fill tube to provide for a controlled release of cleaner from the measuring tube.

20 Claims, 8 Drawing Figures

FIGURE 5
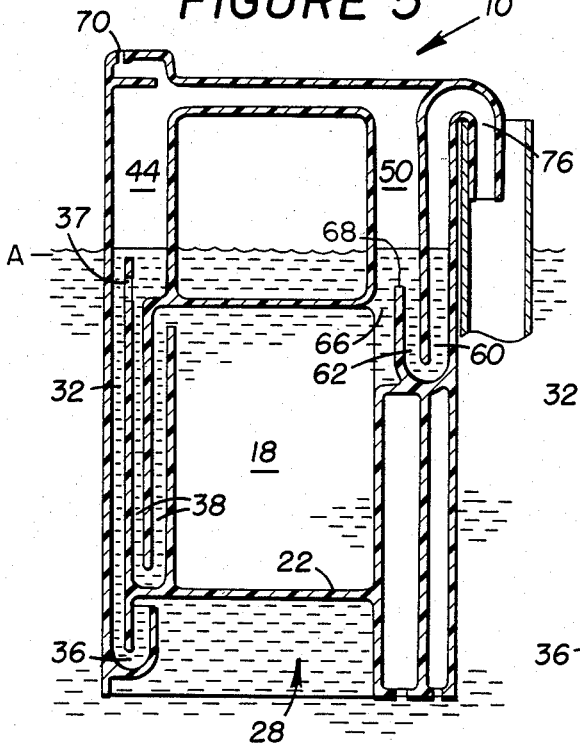
FIGURE 6
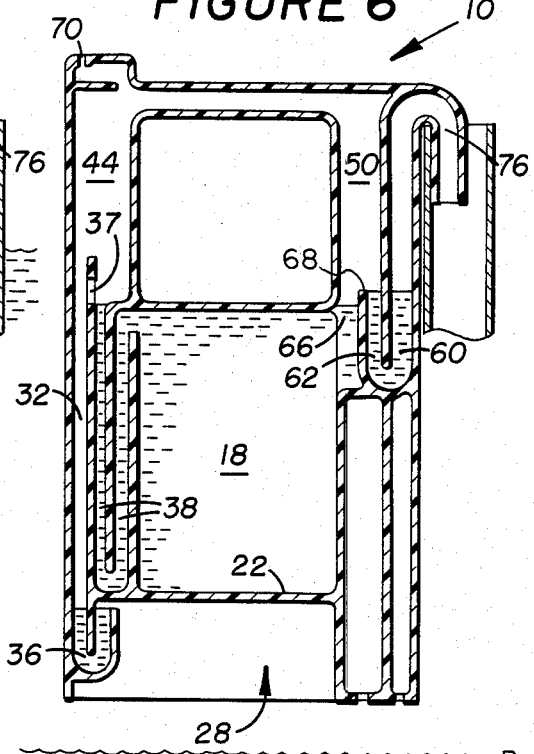
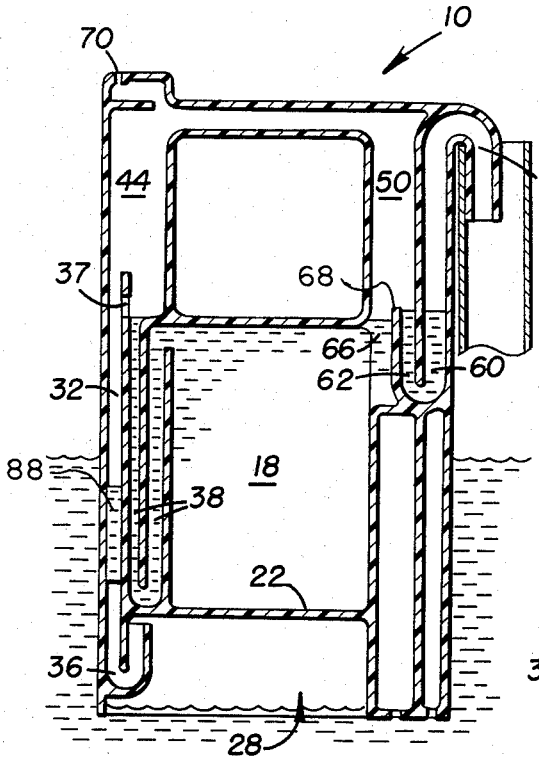
FIGURE 7
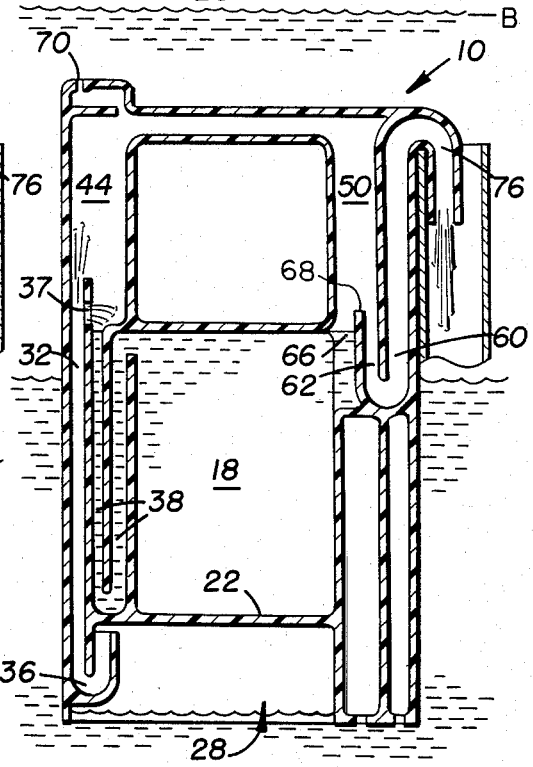
FIGURE 8

TOILET BOWL DISPENSER

DESCRIPTION

1. Technical Field

This invention relates to the field of toilet bowl cleaner dispensers and more particularly to a device for dispensing a measured amount of chemical cleaner directly into a toilet bowl at the end of the flush cycle.

2. Background Art

It has long been recognized that it is desirable to enhance the sanitation of a toilet bowl or similar device by dispensing chemical agents into a toilet bowl solution. Such agents include surfactants, deodorants, disinfectants, bleaches, and sometimes dyes. Thus, devices which provide controlled dispensing of chemical agents into the toilet tank water used for flushing a toilet are well known. However, most of the water in a toilet tank is discharged through the toilet bowl to the sewer upon flushing, and only a small portion is retained in the toilet bowl. Thus, a large part of any chemical ingredients dispensed into toilet tank water is wasted. In addition, some chemicals used as a cleaner, such as calcium hypochlorite will tend to corrode the plumbing fixtures within the toilet tank if they are in extended contact with such chemicals.

Other devices have been designed which discharge a limited amount of active ingredient to the toilet tank water upon flushing. However, such devices are only marginally successful since they nevertheless dispense the agent into the toilet tank water where a large portion is wasted during flushing.

An alternative arrangement which avoids the foregoing problems is a system for delivery of active ingredients directly to the toilet overflow pipe. A large variety of mechanisms for delivering chemical agents to the toilet overflow pipe have been designed. However, such delivery requires a valve mechanism, which in the past have been complex mechanisms which are economically unfeasible and are not easily installed by the household consumer. The only simple devices known which dispense into an overflow pipe are inaccurate and require mechanical valves for filling the reservoir. Furthermore, they do not provide for controlled discharge.

DISCLOSURE OF THE INVENTION

This invention provides a device for injecting chemical agents into a toilet overflow pipe which has no moving parts and is inexpensive to manufacture.

It also provides an overflow pipe dispensing device which delivers a desired amount of chemical agent at a desired time during the toilet flush cycle.

This invention also provides a dispensing device that can accommodate fill level variations in toilet operations as well as a variation in tank fill rates without affecting its operation.

This invention also provides a dispensing system that will maximize chemical utilization in a variety of toilet designs, including front jet and rear jet designs.

Another feature of this invention is that it provides a dispener device that can be stored with dry active chemical for extended periods without degradation, and yet be ready to operate when disposed in a toilet tank.

The present invention also provides a dispenser that will vent off gases evolved from chemical degradation within the dispenser after installation.

The present invention provides a device for dispensing a desired amount of chemical agent into a toilet tank overflow pipe. It is useful for dispensing a variety of agents, but a primary use contemplated is the dispensing of a disinfecting and bleaching agent such as calcium hypochlorite for cleaning of a toilet bowl between flushes. Accordingly, calcium hypochlorite will be used herein as a representative example of a chemical agent for which this device may be employed. However, it will be understood that this example in no way limits the scope of the invention.

The dispenser device has no moving parts and is relatively inexpensive to manufacture, and easy to install.

The dispenser includes an air pressurization device comprising an air cavity, and a reservoir in which is disposed the chemical agent to be dispensed. An air conduit, which may include air chambers, extends from the air cavity to a measuring and dispensing chamber. Fill means is provided to supply solution from the reservoir to fill the measuring and dispensing chamber. Pressurized air from the air pressurization chamber is operable to expel solution from the measuring and dispensing cavity. Control means is provided for controlling the time at which pressurized air is communicated to the measuring and dispensing cavity.

The configuration of a discharge tube for the measuring and dispensing chamber and dispenser body cooperate to form a means for attaching the dispenser on an overflow pipe with the outlet tube disposed in the pipe.

The air pressurization means employs the rising level of water in the toilet tank from a low level to a high level to pressurize air.

When the device is submerged in toilet tank water, the reservoir will fill and solution from the reservoir will also expand into and fill the measuring and dispensing means through a fill means. Upon flushing and the accompanying drop of toilet tank water level, solution in the measuring and dispensing means will be trapped. Thereafter, a rise in pressure in the air pressurization means will be communicated to the measuring and dispensing means to expel solution trapped therein to an overflow tube.

Preferably, control means are disposed in the lower end of the fill tube to trap a small quantity of water when the fill tube empties upon flushing.

When the toilet tank water level rises after flushing, it will trap and pressurize air within the air cavity, which pressurized air will be communicated to the air conduit means, raising the trapped water up the air conduit. Further pressurization of air in the air pump will expel water from a portion of the air conduit, causing a sudden increase of pressure to the measuring and dispensing chamber which will serve to discharge the solution from the measuring and dispensing chamber through an outlet to the overflow tube and the toilet bowl. Continued rising of water in the toilet tank will exhaust air from the air cavity and refill the reservoir and a portion of the air conduit to replace liquid discharged to the bowl.

The amount of hypochlorite solution discharged to the bowl will be determined by the relative dimensions and position of the measuring and dispensing chamber which may be designed to give the desired amount of discharge upon each flush of approximately 0.35 grams. The timing of the discharge will also be affected by the dimensions of the reservoir body to occur at the end of the bowl flush so that most of the disinfectant is retained in the bowl between flushes. Thus, the agent dispensed by the present device will not be immediately flushed to the sewer along with toilet tank water, but will be retained in the bowl. It also will be segregated from any other chemical agents, such as dyes, that are dispensed to the tank, until used after flushing.

Other advantages of the invention will become apparent from review of the following specification and claims, as well as the accompanying drawings.

BRIEF DESCRIPTION OF THE DRAWINGS

In the drawings:

FIG. 5 is a sectional view of the dispenser when tank water is in the full quiescent condition;

FIG. 6 is a sectional view of the dispenser shown when water is flushed from within the toilet tank in which it is disposed;

FIG. 7 is a sectional view of the dispenser shown as water within the tank rises to the dispenser after flushing; and FIG. 8 is a sectional view of the dispenser shown at the time of discharge.

BEST MODE OF CARRYING OUT THE INVENTION

Figure 2:
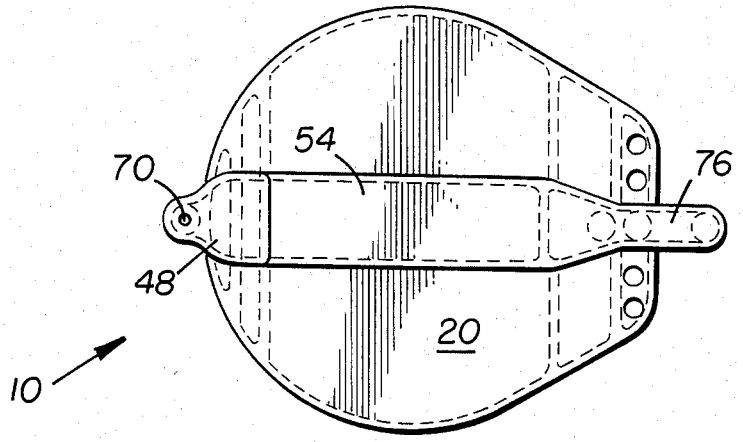
FIG. 2 is a top view of the dispenser of the present invention.
Figure 1:
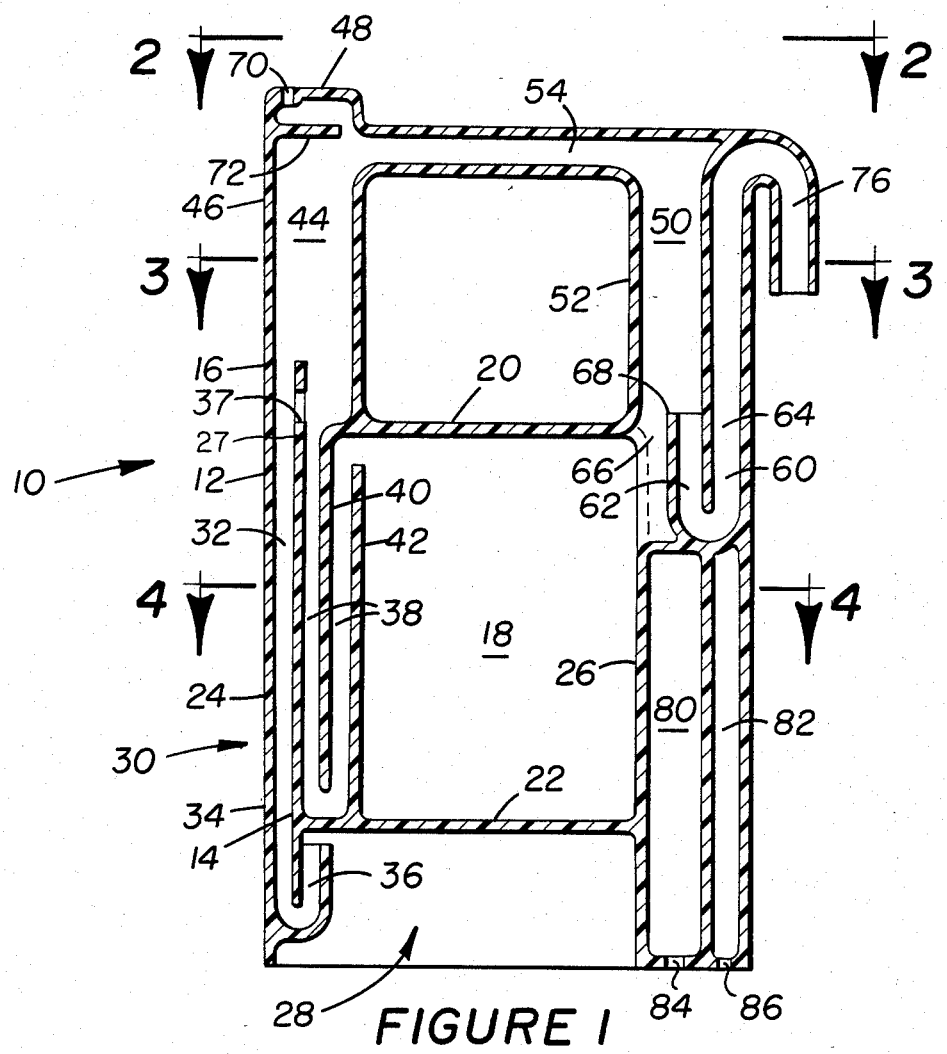
FIG. 1 is a sectional view of a dispenser embodying the present invention.
Figure 3:
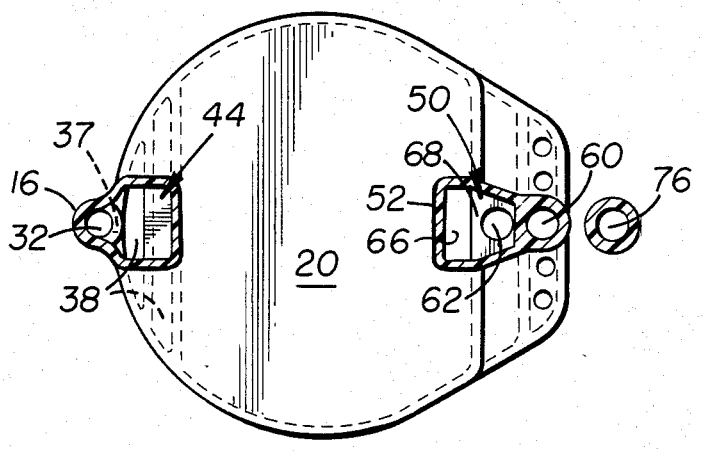
FIG. 3 is a sectional view of the dispenser taken along the lines 3—3 in FIG. 1.
Figure 4:
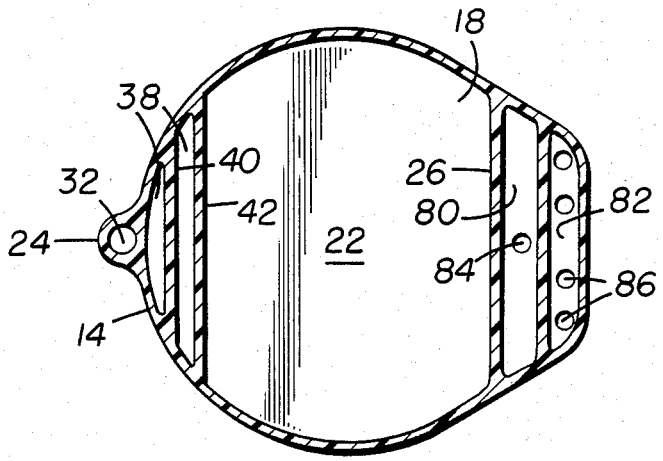
FIG. 4 is a sectional view taken along the lines 4—4 in FIG. 1.

Referring to FIG. 1, the dispensing device of the present invention is shown generally at 10 and comprises a body or housing 12 having a configuration as described hereinbelow. The external configuration of the dispenser body is of a size and shape that can be conveniently disposed within a toilet tank adjacent the overflow tube. The dispenser has inherent means for such disposition which is described herein. Alternatively, a device embodying the present invention may be disposed in the tank by means of a separate hanger, many of which are well known in the art. It will be understood that a toilet overflow pipe communicates with a toilet bowl. Furthermore, a toilet is also equipped with a conventional tank float valve arrangement wherein activation of a flush valve rapidly discharges tank water to the bowl through a front or rear jet, and a rim fill arrangement, forcing the bowl water through a trap to a sewer. At the same time, a float valve admits water to the tank and to the overflow tube to continue supplying the bowl until the tank is refilled.

The dispenser of the present invention is efficacious with both front and rear jet toilets. Between flushes, a toilet tank will be filled with water to a level indicated by the line A in FIG. 5. The dispenser device is mounted within the tank so that the upper portion of the dispenser disposed above the level A, as will be described hereinbelow. It will be understood that the dispenser may be provided with suitable external markings such as a horizontal line indicating the level at which the upper level of the water A should coincide on the dispenser for proper installation thereof.

Referring again to FIG. 1, the dispenser 10 is shown in cross-section. It will be understood by those skilled in the art that such a dispenser may be constructed by molding or thermoforming a plastic dispenser essentially in the configuration as shown. It is anticipated the most economical construction will comprise mirror image molded plastic halves having a configuration similar to that shown in FIG. 1. It will be understood that the device may also be constructed by molding or blowing one side and mating it to a flat back, or other techniques known in the plastic molding art.

The dispenser housing 12 includes a lower generally cylindrical portion 14, and a narrow upper air chamber portion 16. The lower portion includes a reservoir 18 defined by top and bottom walls 20 and 22, a cylindrical side wall 24, and an internal wall 26. Cylindrical side wall 24 and internal wall 26 extend below bottom wall 22 and cooperatively form a depending skirt defining an air pressurization means comprising an air cavity 28.

Initially, the reservoir will contain a dry soluble cake of the chemical agent which is to be dispensed to the toilet bowl. However, after use of the dispenser commences, the reservoir will be filled with toilet tank water, and a portion of the chemical agent will go into solution in the reservoir. It is anticipated that the device of the present invention has optimal application in dispensing a disinfectant such as calcium hypochlorite to the overflow tube and thus the cake will comprise such material. However, it will be understood that the dispenser of the present device is also suitable for dispensing other materials, such as surfactants, fragrances, and dyes.

A combined reservoir inlet means and air conduit means is shown generally at 30 and includes a fill tube 32 formed on side wall 24 by a vertical tube wall 34 which extends below bottom wall 22 into air cavity 28.

Although it is not necessary for satisfactory operation of the present invention, it is preferable to provide the lower end of fill tube 32 with a J-shaped portion 36, which serves to enhance forceful expulsion of solution from the dispenser, as described below, regardless of water level rise rate in the toilet tank. Fill tube 32 terminates at an upper end which is disposed just above the reservoir. When J-tube 36 is provided, it is desirable to also provide a port 37 in the upper end of the tube to allow for alternate paths of escape of air and water from the tube, as described hereinbelow.

The inlet means also includes an inlet passage 38 formed by side wall 27 and a cooperating vertical baffle wall 40 which depends from top wall 20 and terminates in the lower interior of the reservoir, and an upstanding baffle wall 42 which extends from bottom wall 22 up to the upper portion of the reservoir. Said baffles serve to limit migration of solution from the reservoir.

The air conduit means further comprises a first air chamber 44 disposed immediately above inlet means 30, which is provided by a channel member 46 which extends above the reservoir and terminates in a top 48. The inlet and fill tube portions of inlet means 30 are in open communication with air chamber 44, and with each other through the chamber.

The air conduit means also includes a second air chamber 50 disposed above an opposite side of the reservoir from the first air chamber, and formed by a second channel member 52 parallel to channel member 46.

Measuring means for measuring and retaining a quantity of solution to be dispensed comprises a U-tube 60 having an inlet leg 62 and an outlet leg 64.

Fill means for filling the U-tube from the reservoir comprises an expansion chamber formed by the second air chamber and an outlet passage 66 which communicates the reservoir with second air chamber 50. The outlet passage is separated from the U-tube by an upper extremity of the inlet leg of U-tube 60 which terminates in a top edge 68 which is above the top of the reservoir and fill tube 34. The air conduit means also comprises an air tube 54 which communicates the upper portions of the first and second air chambers. It will be appreciated that the first and second air chambers and the air tube communicating them could alternatively comprise a single air chamber arranged to communicate air cavity pressure to U-tube 60 and allow filling of the U-tape from the reservoir.

An orifice vent 70 is provided in the top of chamber 44 to vent the air chambers upon a drop of water level in the toilet tank, and also to vent gases evolved within the reservoir to atmosphere. A baffle 72 protects the vent from liquid contamination that could plug the vent. The vent is small enough so that it will not vent air fast enough to relieve air pressure created by the air pump, and thus it does not otherwise affect operation of the dispenser as described below.

The outlet leg of U-tube 60 extends along channel member 46 to the top thereof, and terminates in a hook-shaped discharge tube 76. U-tube 60 and air chamber 50 may be formed in a single housing member and discharge tube 76 may be arranged to extend outward therefrom in such a manner that the dispenser may be hung adjacent a toilet overflow pipe by hooking the discharge tube over the pipe. The dispenser device of the present invention may be used to dispense agents directly to the toilet tank if desired by communicating discharge tube 76 to the tank. However, it is believed that the greatest benefit from the present invention will be realized if the discharge tube is communicated directly with the bowl through the overflow pipe.

Reservoir chambers 80 and 82 may be provided for dispensing other agents, such as perfume and dye, directly to toilet tank water through bottom ports 84 and 86 and through upper orifices, not shown.

Referring to FIG. 5, when the dispenser is so disposed in a toilet tank so that tank water is at a level A with respect to the dispenser, tank water will flow through fill tube 32 and inlet passage to fill the reservoir 18 which is vented through passage 66 and U-tube 60 to outlet tube 76. Since level A is above the fill tube and the top edge 68 of U-tube 60, the entire dispenser, including the fill tube inlet passage and U-tube 60 will fill until the liquid level therein reaches level A as shown in FIG. 5. A portion of the calcium hypochlorite cake will dissolve in the water until a saturated solution is reached in reservoir 18.

Referring to FIG. 6, when the toilet is flushed, the water level in the tank will drop rapidly to level B. Water in the air chambers and in fill tube 32 will drain, but water will be retained in inlet passage 38 below port 37; and solution will remain in the reservoir and passage 66 below port 37,, and in U-tube 60 below edge 68 as shown in FIG. 6. When J-tube 36 is provided on the lower end of the fill tube, a small amount of water will also be trapped in J-tube 36. Vent 70 will prevent a drop in air pressure in the air chambers.

When the tank refills and the rising level of water in the tank reaches the bottom of air cavity 28, it will trap air within the cavity 28. As the tank water level continues to rise, the air within cavity 28 will become pressurized by the weight of the rising water level in the tank.

If J-tube 36 is not provided, this air pressure will be reflected through fill tube 32 to first air chamber 44, and then through air tube 54 to second air chamber 50, where it will be applied to the liquid in U-tube 60. Continuing increase in air pressure will depress liquid in inlet leg 62 of U-tube 60, and raise a similar column of water in outlet leg 64. When the water in inlet leg 62 is depressed to the bottom of U-tube 60, further rise of air pressure in chamber 44 will not be resisted by further raising of the column of solution in outlet leg 64. Therefore, upon further rising of toilet tank water and increase of pressure in air cavity 28, communicated to U-tube 60, the solution in outlet leg 64 will be rapidly and forcefully expelled by the increased air pressure through discharge tube 76 to the toilet overflow pipe.

The expulsion of solution from the U-tube is enhanced and made independent of the rate of water level rise in a toilet tank by providing a control means comprising a J-tube 36 on the bottom of fill tube 32. When water drains from the toilet tank and fill tube 32 upon flushing, a selected quantity will be trapped in J-tube 36, as shown in FIG. 6. Pressurization of the air cavity upon rising of toilet tank water will then cause and be resisted by the raising of a like column of water 88 in fill tube 32, and the surface tension resistance to movement thereof. When the tank water head is sufficient to overcome such surface tension and to raise all the J-tube water to a column in the fill tube, further increases in the tank water head will be resisted only by surface tension, friction and acceleration forces. Therefore, the column or slug of water 88 will rapidly rise in the fill tube. Small pressure increases in the air chambers caused by the rising water slug will be bled off by vent 70 until the water slug is raised to and expelled from the top of the fill tube. When the water slug reaches port 37, a portion will escape through the port, while some is expelled from the end of the tube. Upon such expulsion of water slug 88, a surge of air pressure will be immediately reflected in air chambers 44 and 50 and upon the solution in U-tube 60, which will be effective to expel the solution from the U-tube and the discharge tube. The expulsion of water slug 88 from the fill tube will be enhanced by providing an escape port 37 which allows the water slug to be rapidly discharged from the fill tube while clearing a path for communication of increased air pressure to the air chambers.

The relative dimensions of the fill tube are selected so that the water from the J-tube reaches the top of the fill tube at the desired time, and is released into chamber 44, providing a sudden increase in air pressure in U-tube 60 which effects forceful expulsion of U-tube solution to the overflow pipe.

In this manner, the preselected amount of solution initially disposed in U-tube 60 will be discharged to the toilet overflow tube. Such discharge will occur near the end of the toilet tank fill cycle just before water dispensed to the overflow tube and the bowl is cut off. Thus, the chemical agent dispensed to the overflow tube will be retained in the bowl until the toilet is again flushed.

When the liquid in U-tube 60 is discharged, air pressure within air cavity 28, fill tube 32 and air chambers 44 and 50 will be vented through U-tube 60 to discharge tube 76. Toilet tank water will then fill air cavity 28 below the reservoir and will then rise through fill tube 33 to level A in chamber 44. It will also flow through inlet passage 34 into reservoir 18, causing displacement of solution out through passage 66 into U-tube 60 until all levels again reach level A, as shown in FIG. 5.

It will be apparent from the foregoing description that the top of edge of the fill tube, which may be defined by an escape port provided therein, and the passage from the fill tube to passageway 38 must be at or above the top of the reservoir to avoid draining of any solution from the reservoir upon flushing. Furthermore, the top of the U-tube inlet leg must be above the top of the fill tube to insure premeasurement of solution by the U-tube.

It is contemplated that optimum use of the dispenser of the invention would provide for its use to discharge a disinfectant, such as calcium hypochlorite, in premeasured amounts to the toilet bowl where it will clean the bowl between flushes. Since the active chemical agent within the dispenser is not dispensed to toilet tank water, which is rapidly flushed through the bowl to sewer during the flushing cycle, the chemical agent is not wasted by rapid flushing to the sewer, but instead is retained within the bowl for active action between flushes.

Although a U-tube and J-tube have been described for the measuring means and control means respectively, any liquid chamber configuration constructed to trap and hold a preselected quantity of liquid unit air pressure is communicated thereto may be employed, and the present invention is not limited to the configurations described.

Other aspects, objects and advantages of this invention can be obtained from a study of the drawings, the disclosure and the appended claims.

What is claimed is:

1. A toilet bowl cleaner dispenser for dispensing a preselected amount of saturated solution after each flushing of a toilet bowl comprising, a reservoir constructed for disposing within a toilet tank and for holding a chemical agent to be discharged, measuring means for holding a preselected measured, discrete quantity of solution to be dispensed, fill means for filling said measuring means from said reservoir upon flooding of the reservoir, air pressurizing means for providing pressurized air in response to rising ambient tank water for discharging solution from the measuring means, combined water inlet and air conduit means for flooding the reservoir with toilet tank water between flushes, and for communicating a surge or air pressure from the air pressurizing means to said measuring means, prior to said flooding and discharge means connecting the measuring means for discharging solution from the measuring means.

2. The dispenser of claim 1 wherein said fill means comprises and air chamber disposed above and in fluid communication with the reservoir and an inlet portion of said measuring means, and outlet passage means 66 for communicating the reservoir with the air chamber, whereby upon flooding of the reservoir fluid will rise into the air chamber and fill the measuring means.

3. The dispenser of claim 1 wherein said air conduit means comprises pressure control means for suddenly communicating air pressure from the air pressurizing means to the measuring means at a pre-selected time.

4. The dispenser of claim 3 wherein said pressure control means includes means defining a J-tube in a portion of said air conduit means.

5. The dispenser of claim 4 wherein the J-tube and fill tube are dimensioned to provide a column of water within the fill tube in response to pressurization by the air pressurization means equal to a desired head of tank water in the toilet flush cycle.

6. The dispenser of claim 3 wherein the air conduit means includes a fill tube extending from the air pressurization means to the air chamber means, and wherein said inlet means further comprises inlet passage means for communicating water from the fill tube to the reservoir.

7. The dispenser of claim 6 wherein the fill tube further comprises port means for communicating water from the fill tube to the inlet passage means.

8. The dispenser of claim 6 wherein the fill tube and the air chamber means are in communication with the inlet passage means.

9. The dispenser of claim 6 wherein the air chamber means comprises, a first air chamber disposed above said reservoir and said fill tube in communication therewith and with said inlet passage means, and a second air chamber disposed above said reservoir in communication with said measuring means and outlet passage means, and means for communicating said first air chamber with said second air chamber.

10. The dispenser of claim 9 wherein said measuring means comprises a U-shaped tube which includes an inlet portion in communication with the second air chamber and an outlet portion in communication with the discharge tube.

11. The dispenser of claim 9 further comprising vent means for venting slow pressure changes within the air chamber means, said vent means being incapable of venting rapid rises within the air chamber means.

12. The dispenser of claim 9 wherein said fill tube and said J-tube are of sufficiently small cross-section that surface tension forces will significantly resist movement of liquids through said tubes.

13. Dispenser apparatus for dispensing a controlled amount of disinfectant to the bowl of a toilet through the toilet overflow tube without mixing the disinfectant chemical agent with water in the tank and for dispensing the agent late in the flush cycle, said dispenser apparatus comprising, a container constructed for partial immersion in the water of a toilet tank when the water is at a full level in the tank and dimensioned to have a chamber suspended above water in the tank when said water is at its lowest level in the tank during the flush cycle of the toilet, said container having a reservoir for holding a supply of chemical agent, measuring means operatively associated with the reservoir for retaining a preselected, measured amount of chemical agent to be fed to the toilet bowl during a flush cycle, discharge conduit means for conveying the measured amount of disinfectant from the measuring means to the overflow tube of a toilet, air pressurization means for trapping air in the air chamber for subsequent pressurization thereof as water refills the tank during a flush cycle, and combined water inlet and air conduit means for transmitting a surge pressurized air from the air pressurization means to the measuring means followed by flow of tankwater to said reservoir.

14. The dispenser apparatus of claim 13 further comprising control means for controlling the time in the cycle at which pressurized air in the air pressurization means is applied to the measuring means, and for providing for sudden communication of air pressure to the measuring means.

15. The dispenser apparatus of claim 14 wherein said pressurizing air conduit means includes means for transmitting liquids from the air pressurization means to the reservoir, and said control means comprises means provided in said pressurized air conduit means for catching and retaining a preselected quantity of liquid upon flushing of water from the toilet tank whereby communication of air pressure within the air pressurization means to the measuring means will be delayed until the toilet tank water head with respect to the air chamber raises the water caught in said retaining means to an equal column in the pressurizing conduit means.

16. The device of claim 15 wherein said pressurizing air conduit means further comprises dimensional means for applying surface tension forces of the column of liquid disposed within the pressurizing conduit means to resist advancement of such a column of liquid through said pressurizing air conduit means.

17. The device of claim 15 wherein said pressurizing air conduit means includes port means for quickly expelling water from said control means when it is raised to a selected length by the air pressurization means, whereby air pressure of the air pressurization means will suddenly operate on the measuring means to discharge solution therein.

18. A method of dispensing a premeasured amount of disinfectant to the bowl of a toilet without mixing the disinfectant with the water in the toilet tank and at a selected point late in the flush cycle, said method comprising, providing a reservoir of saturated solution of the disinfectant, filling a measuring and dispensing chamber with said solution from the reservoir, pressurizing trapped air in an air chamber by the rising level of water in the toilet tank during refill of the tank, communicating the pressurized air to the measuring and dispensing chamber, and providing for a surge of air pressure at the measuring and dispensing chamber sufficient to expel disinfectant from the chamber upon filling of the toilet tank to a selected level near the completion of the flush cycle.

19. The method of claim 18 further comprising the step of delaying application of pressurized air from the chamber to the measuring and dispensing chamber until the last part of the tank refill cycle so that the measured amount of disinfectant is retained in the toilet bowl and does not flow out of the toilet bowl through the trap during refill of the toilet bowl.

20. The method of claim 19 including transferring pressurized air from the pressure chamber to a measuring chamber by a conduit structure which includes a water column formed in the course of the flush cycle and which is formed in a portion of the conduit structure with increasing pressure in the air chamber and progressively advances therethrough until it overflows the said portion of the conduit structure and allows pressure in the chamber to be communicated to the measuring and dispensing chamber, and including venting the measuring and dispensing chamber by an orifice which is large enough to prevent any pressure build-up until the entire water column overflows the portion of the conduit structure in which is small enough that rapid build-up in pressure upon overflow of the water column will generate sufficient pressure in the measuring and dispensing chamber to force disinfectant out of the measuring and dispensing chamber into the toilet tank overflow pipe.

* * * * *